US006039053A

United States Patent [19]

Turrentine

[11] Patent Number: 6,039,053

[45] Date of Patent: Mar. 21, 2000

[54] COSMETIC APPLICATOR

[76] Inventor: Mary Faye Turrentine, 105 Anna Belle Ct., Smyrna, Tenn. 37167

[21] Appl. No.: 09/265,636

[22] Filed: Mar. 10, 1999

[51] Int. Cl.[7] ..... A45D 40/26

[52] U.S. Cl. ..... 132/320; 132/317; 401/6; 15/143.1; 15/145; 15/176.1

[58] Field of Search ..... 132/320, 216, 132/218, 317, 207, 208; 401/6; 15/143.1, 145, 176.1, 176.6

[56] References Cited

U.S. PATENT DOCUMENTS

| | | | |
|---|---|---|---|
| D. 290,173 | 6/1987 | Taylor et al. . | |
| D. 305,369 | 1/1990 | Gavin . | |
| D. 328,366 | 7/1992 | Villani . | |
| 1,708,052 | 4/1929 | Channell | 15/143.1 |
| 2,162,584 | 6/1939 | Kole | 132/320 |
| 2,218,862 | 10/1940 | Vredenburgh | 132/320 |
| 3,908,675 | 9/1975 | Spatz et al. . | |
| 4,598,437 | 7/1986 | Ernest et al. | 15/176.1 |
| 4,627,454 | 12/1986 | Dahm . | |
| 4,922,575 | 5/1990 | Riemann | 15/143.1 |
| 5,121,763 | 6/1992 | Kingsford . | |
| 5,123,431 | 6/1992 | Wilson . | |
| 5,324,128 | 6/1994 | Gueret . | |
| 5,487,203 | 1/1996 | Brach, Jr. et al. | 15/145 |
| 5,716,150 | 2/1998 | Gueret . | |
| 5,775,829 | 7/1998 | Packham et al. | 401/129 |

*Primary Examiner*—Gene Mancene
*Assistant Examiner*—Pedro Philogene
*Attorney, Agent, or Firm*—Jeffrey L. Thompson; Thompson & Thompson, P.A.

[57] ABSTRACT

A cosmetic applicator includes a body adapted for grasping by a user having a base with at least three walls extending upwardly therefrom. Each side presents a purchase surface for receiving one of the fingers of a user. The walls converge to form a top section of the handle. An applicator is releasably attached to the top section of the handle for receiving a cosmetic material thereon. The applicator includes a base having at least three sides with a face extending upwardly from each side of the applicator base. The applicator faces converge to form an applicator top, each face being generally parallel to a respective corresponding wall of the handle.

15 Claims, 5 Drawing Sheets

COSMETIC APPLICATOR

BACKGROUND OF THE INVENTION

This invention relates generally to cosmetic applicators and, more particularly to an improved cosmetic applicator that is easier to grasp and use by persons having decreased strength or dexterity in their fingers.

Persons having arthritis and other disabilities often find it difficult to pick up or grasp small items such as pencils and the like. The ability to hold small items such as make-up applicators, lip stick wands, etc. with sufficient grip so as to successfully apply the make-up is a particular challenge. As a result, elderly persons and those with dexterity challenges often have no choice but to forego the desired application of cosmetics or must have assistance from others.

Several devices for applying cosmetics are known in the prior art. Although assumably effective, such devices present configurations that are difficult to grasp or grip by persons having decreased strength and dexterity in their fingers.

It is therefore desirable to have a cosmetic applicator that does not require a precise or narrow gripping of a person's fingers about the applicator handle to successfully apply a cosmetic. It is further desirable to have an applicator in which the tip is always suitably oriented for application of the cosmetic regardless of the orientation of the handle. It is also desirable to have an applicator in which the tip is removable for exchange with another tip.

SUMMARY OF THE INVENTION

In response thereto, I have invented a cosmetic applicator having a handle particularly adapted to be grasped by persons with decreased dexterity in their fingers. The handle includes a triangular base having three sides. A wall upwardly extends from each side of the base to present a surface for one of the fingers of a user. The walls converge to form a top section of the handle. The cosmetic applicator further includes an applicator tip having a triangular base presenting three edges. A rectangular face extends from each base edge with converging triangular faces to form an applicator top. Each applicator tip face is generally parallel to a corresponding triangular face configuration of a handle wall. This configuration is particularly advantageous in that a face of the applicator tip is always properly oriented to apply a cosmetic to a facial surface regardless of which fingers of a user are grasping particular walls of the handle.

It is therefore a general object of this invention to provide a cosmetic applicator which can be held securely by a user without a tight or narrow gripping of the user's fingers.

Another object of this invention is to provide a cosmetic applicator, as aforesaid, which is ergonomic when grasped by a user's fingers.

Still another object of this invention is to provide a cosmetic applicator, as aforesaid, in which the handle is pliable for enhanced gripping by a user.

Yet another object of this invention is to provide a cosmetic applicator, as aforesaid, having finger recesses for enhanced gripping by a user.

A further object of this invention is to provide a cosmetic applicator, as aforesaid, which suitably orients a face of the applicator to apply a cosmetic regardless of the orientation of the handle.

A still further object of this invention is to provide a cosmetic applicator, as aforesaid, in which the applicator tip is removable for replacement or exchange with a different tip.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
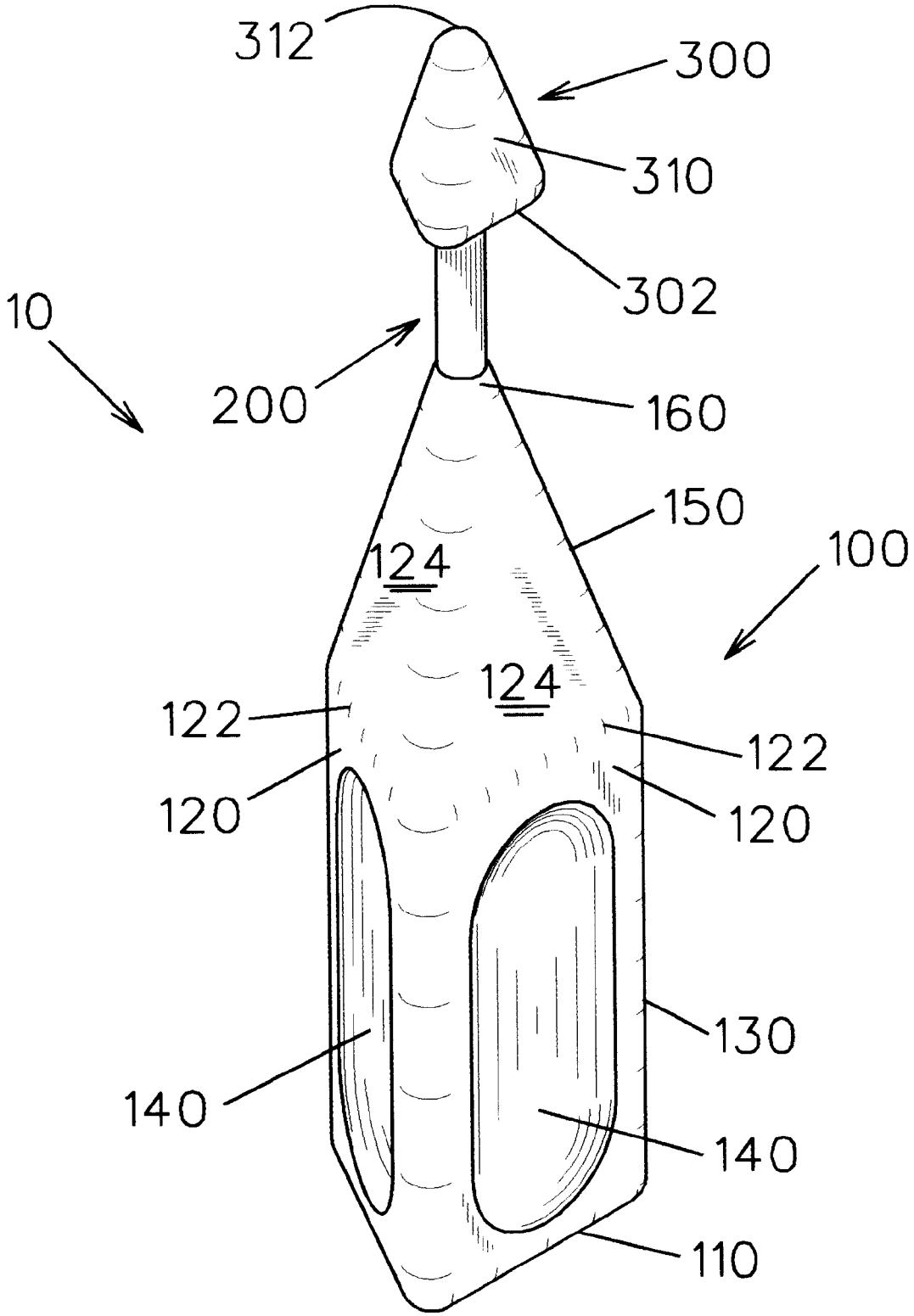
FIG. 1 is a perspective view of the preferred embodiment of the cosmetic applicator.

Turning more particularly to the drawings, FIG. 1 shows a preferred embodiment of the cosmetic applicator 10 having a handle 100, a stem 200, and a tip 300. The handle is preferably unitarily constructed of a lightweight, semi-rigid material that is easy to grip. The handle 100 includes a base 110 having three rectangular sides 120 extending upwardly therefrom. The sides 120 are integrally molded together in a triangular configuration, each side being a mirror image of the others. Bse member 110 is optional if an open ended handle 100 is preferred.

Each handle 100 side 120 presents a lower section 130 normal to an edge of the base 110, each side presenting a width sufficient to fully accommodate a user's finger or thumb. Each side 120 of the handle 100 includes a top edge 122 spaced apart from the base 110. The handle 100 further includes an upper section 150 having a pyramidal configuration. More particularly, a triangular face 124 extends from each upper edge 122 of the lower section 130 and slopes inwardly with decreasing width, the faces 124 converging to form a top 160 of the handle 100. It is understood that the sides 120 of the handle 100 need not be normal to the base 110, but rather may extend from the base 110 and converge to form the top 160 without presenting the sloping faces 124 of the upper section 150. Each side 120 includes a shallow recess 140 having a width sufficient to receive at least a portion of a user's finger therein such that the finger is inhibited from slipping off the side 120 of the handle 100.

Figure 2A:
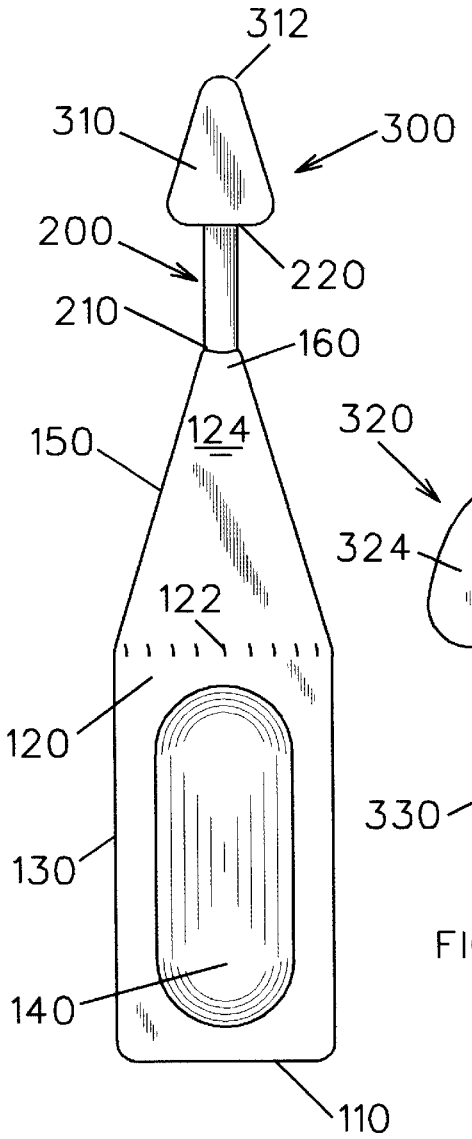
FIG. 2A is a front view of the cosmetic applicator of FIG. 1.
Figure 5:
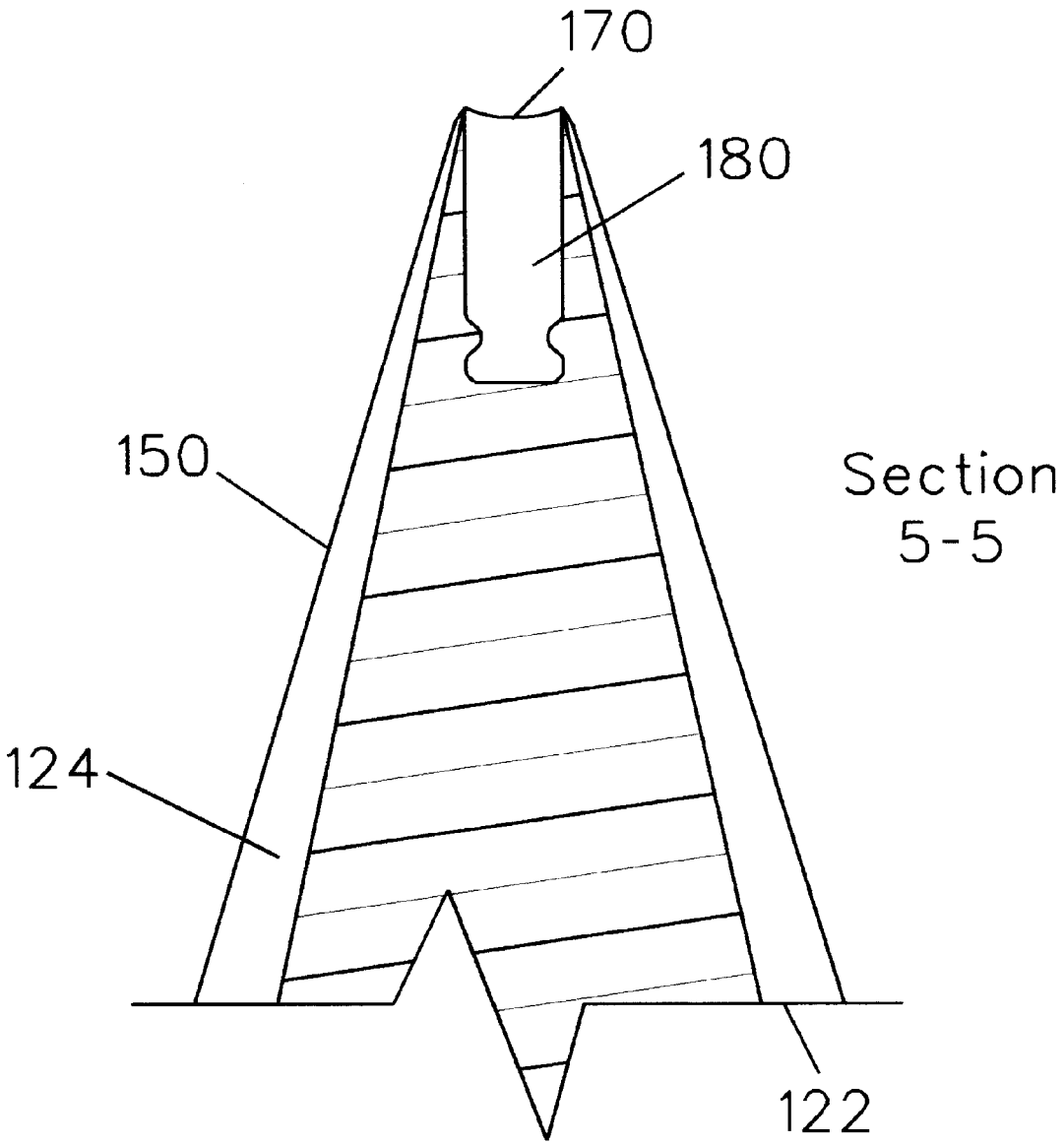
FIG. 5 is a sectional view of the cosmetic applicator taken along line 5—5 of FIG. 4 on an enlarged scale.

The cosmetic applicator 10 includes a stem 200 having first 210 and second 220 ends (FIG. 2A). As shown in FIG. 5, the top 160 of the handle 100 presents an aperture 170 with a stem seat 180 extending therefrom within the handle 100. The first end 210 of the stem 200 presents a configuration complementary to the bore within seat 180 such that the stem 200 releasably mates within the bore seat 180.

The applicator 10 includes a tip 300 fixedly attached to the second end 220 of the stem 200 for applying a cosmetic substance to a surface such as a person's cheeks, lips, eyelids, eyelashes, etc. Preferably, the tip 300 is constructed of suede or a soft foam material to which a cosmetic will readily adhere as well as being soft when pressed against a facial surface. The preferred tip 300 includes a triangular base 302 presenting three edges. A triangular face 310 extends from each base edge, the faces 310 converging to form a top 312. Each face 310 of the tip 300 is generally parallel to a respective corresponding face 124 of the upper section 150 of the handle 100. Thus, one face 310 of the tip 300 is always properly oriented to apply a cosmetic to a facial surface regardless of which sides 120 of the handle 100 have been grasped by particular fingers of a user's hand. Once grasped, the applicator handle 100 need not be further manipulated or reoriented during use.

Figure 2B:
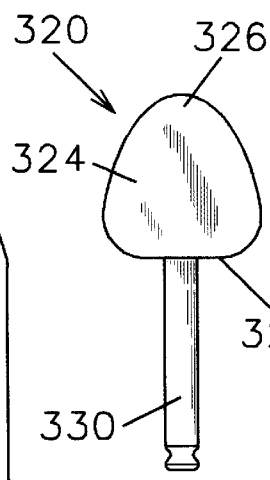
FIGS. 2B through 2D are front views of alternative applicator tips that are interchangeable with the preferred applicator tip.
Figure 2C:
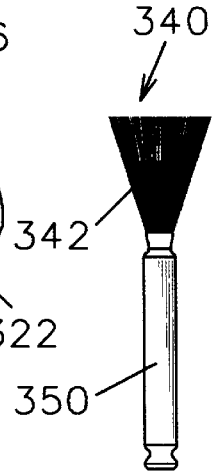
Figure 2D:
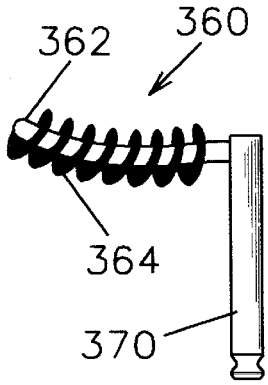
Figure 3:
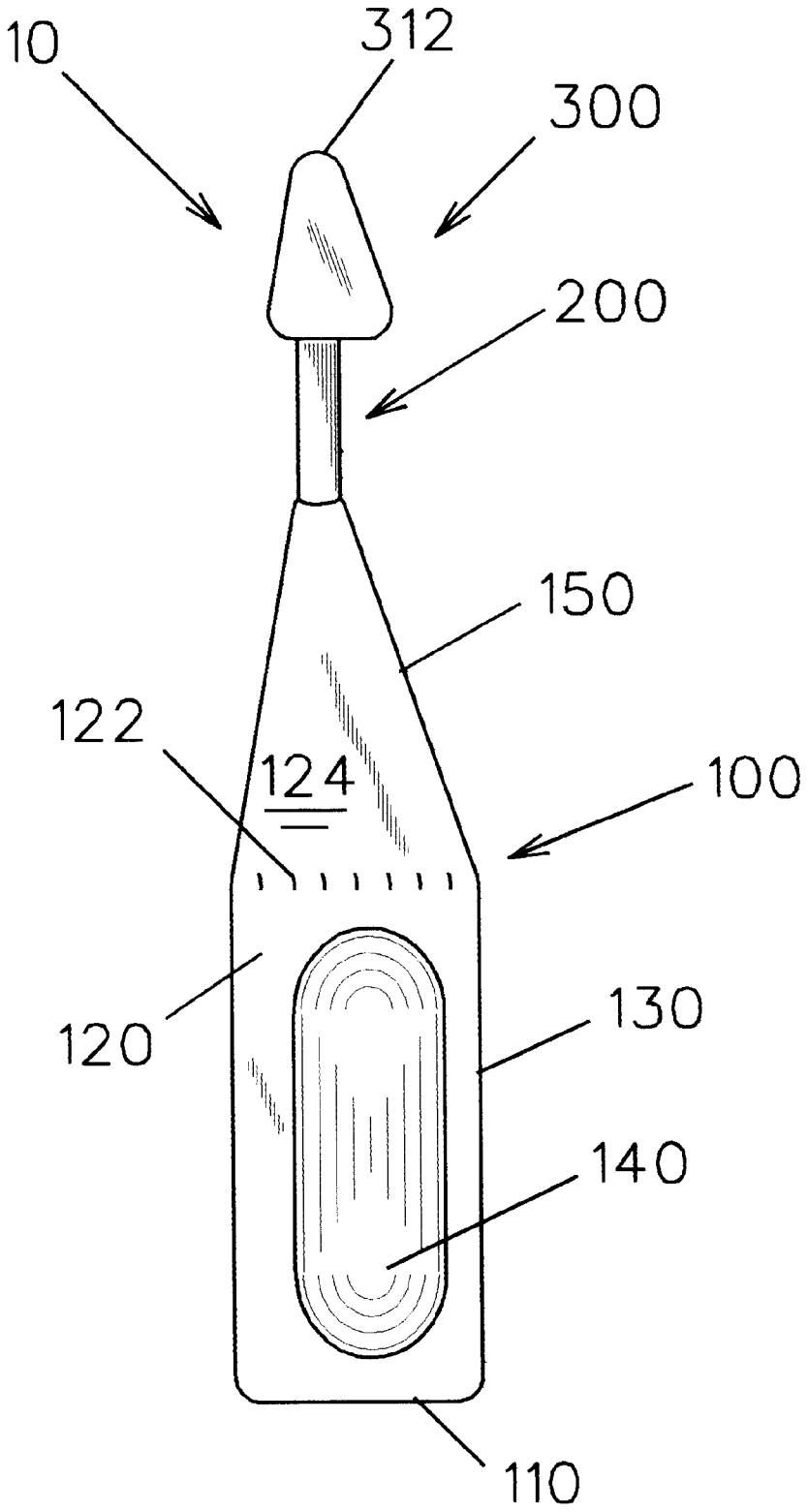
FIG. 3 is a right side view of the cosmetic applicator of FIG. 1.
Figure 4:
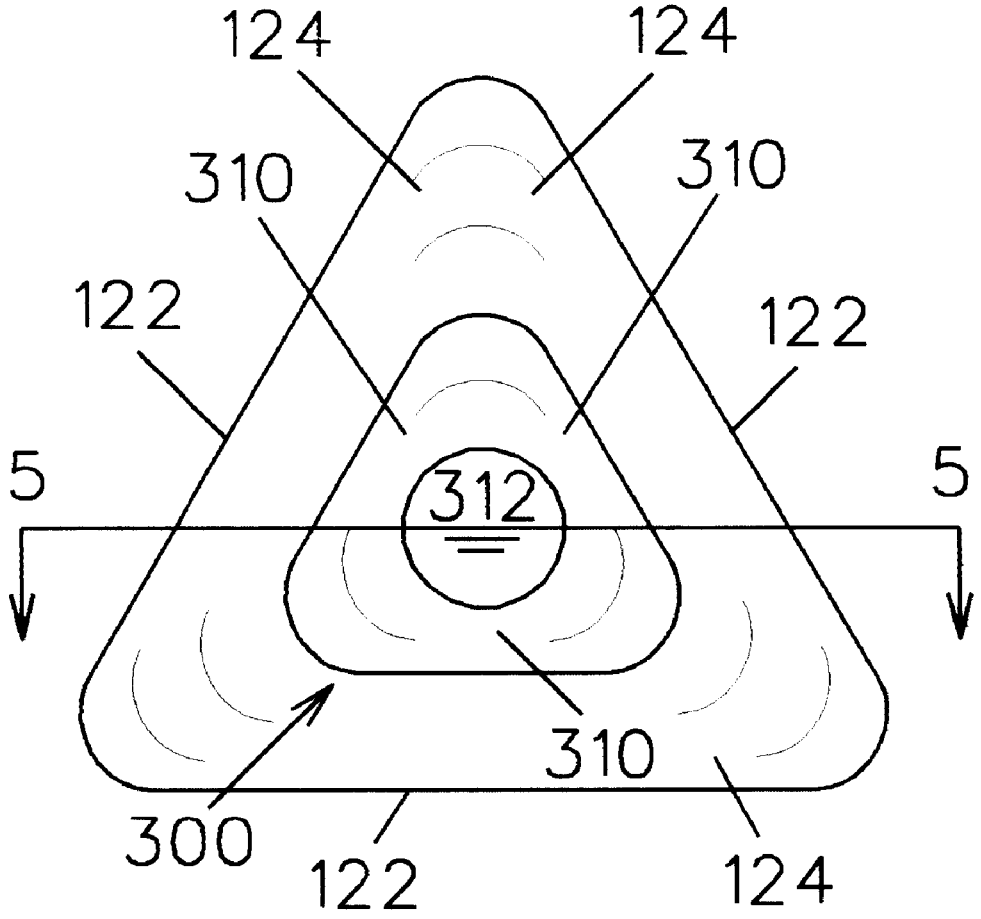
FIG. 4 is a top view of the cosmetic applicator of FIG. 1.

Various other tips 320, 340, 360 may be releasably attached to the handle 100 in the manner previously described, each alternative tip having a stem 330, 350, 370, respectively. The alternative tips 320, 340, 360 shown in FIGS. 2B through 2D are particularly applicable for applying eye shadow, eye liner, and mascara, respectively. Each of the tips, however, presents dimensions larger than known make-up applicators such that complete application of a cosmetic substance to a desired facial surface can be accomplished in a single stroke, thus eliminating the multiple strokes or "painting" often required with traditional applicators. Tip 320 includes a generally circular base 322 having a face 324 extending upwardly therefrom and converging to form a rounded top 326. Tip 340 presents a brush 342 extending in a fan-like configuration. The mascara tip 360 includes a wand 362 normal to the stem 370 with a brush 364 spirally attached about the wand 362. Tip 360 is particularly suited for applying mascara to a person's lower eyelashes with a single stroke.

In use, the handle 100 may be grasped by placing the thumb, first finger, and second finger of a user's hand within the shallow recesses 140 of the sides 120 and gently gripping the handle 100. The triangular configuration of the handle 100 is ergonomic to a user's hand in that a gripping together of the thumb and first two fingers creates a natural triangular configuration. The particular sides 120 grasped by particular fingers is not relevant to use in that the tip 300 presents faces 310 that are generally parallel with respective corresponding faces 124 of the top section 150.

Accordingly, it can be seen that the cosmetic applicator 10 of the present invention can be grasped more easily by persons having decreased dexterity or strength in their fingers. Further, the cosmetic applicator 10 allows make-up to be applied more quickly and with less manipulation of the applicator handle during use.

It is understood that while certain forms of this invention have been illustrated and described, it is not limited thereto except insofar as such limitations are included in the following claims and allowable functional equivalents thereof.

Having thus described the invention, what is claimed as new and desired to be covered by Letters Patent is as follows:

1. A material applicator comprising:

a body adapted for grasping by a user, said body comprising:

a triangular base presenting first, second and third sides;

a first wall upwardly extending from one of said base sides, said first wall adapted to present a purchase surface for one of the fingers of a user;

a second wall upwardly extending from a second of said base sides, said second wall adapted to present a purchase surface for a second of the fingers of a user;

a third wall upwardly extending from a third of said base sides, said third wall adapted to present a purchase surface for a third of the fingers of a user, each of said walls including a triangular configuration, an apex of each triangular wall configuration converging to form a top of said body;

an applicator adapted for receiving the material thereon, said applicator comprising:

a triangular base presenting first, second and third edges, a face extending from each edge of said applicator base and converging to form a top, each face of said applicator generally parallel to a corresponding triangular configuration of said wall of said body; and means for attaching said applicator to said top of said body in extension therebeyond.

2. The material applicator as claimed in claim 1 further comprising a recess in at least one of said walls for seating a portion of the respective finger therein.

3. The material applicator as claimed in claim 1 wherein each applicator face is triangular in configuration, an apex of each face converging to form said top of said applicator.

4. A material applicator comprising:

a body adapted for grasping by a user, said body comprising:

a triangular base presenting first, second and third sides;

a first rectangular wall upwardly extending from one of said base sides, said first wall adapted to present a purchase surface for one of the fingers of a user;

a second rectangular wall upwardly extending from a second of said base sides, said second wall adapted to present a purchase surface for a second of the fingers of a user;

a third rectangular wall upwardly extending from a third of said base sides, said third wall adapted to present a purchase surface for a third of the fingers of a user, each of said walls presenting a top edge spaced from said base;

a face extending from each top edge of said walls, said faces converging to form a top of said body;

an applicator adapted for receiving the material thereon, said applicator comprising:

a triangular base presenting first, second and third edges;

a face extending from each edge of said applicator base and converging to form an applicator top, each face of said applicator generally parallel to a respective corresponding face of said body; and means for attaching said applicator to said faces at said top formed by said convergence.

5. The material applicator as claimed in claim 4 wherein each of said faces are triangular in configuration, an apex of each face converging to form said top of said body.

6. The material applicator as claimed in claim 5 further comprising a recess in at least one of said walls for seating a portion of the respective finger therein.

7. The material applicator as claimed in claim 4 wherein each face is triangular in configuration, an apex of each face converging to form said top of said applicator.

8. A material applicator comprising:

a body section adapted for grasping by a user, said body section comprising:

at least three upwardly extending walls, each wall presenting a top edge spaced from a lower edge and adapted to present a purchase surface for one of the fingers of a user;

a top section atop said walls including a face extending from each top edge, said faces converging to form said top section of said body;

an applicator adapted for receiving the material thereon, said applicator comprising:

a base presenting at least three edges;

a face extending from each edge of said applicator base and converging to form an applicator top, each face of said applicator generally parallel to a respective corresponding face of said body; and means for attaching said applicator to said top section in extension therebeyond.

9. The material applicator as in claim 8 wherein said body section comprises three walls, said lower edges forming a triangular base for said body section.

10. The material applicator as claimed in claim 8 wherein each of said faces of said top section are triangular in configuration, an apex of each face converging to form said top section of said body.

11. The material applicator as claimed in claim 8 further comprising a recess in at least one of said walls for seating a portion of the respective finger therein.

12. The material applicator as claimed in claim 8 wherein each face of said applicator is triangular in configuration, an apex of each face converging to form said top of said applicator.

13. A material applicator as claimed in claim 8 wherein said applicator attaching means comprises:

a stem extending from said applicator; and a seat in said top section configured to engage said stem therein.

14. A material applicator as in claim 13 wherein said stem is in a friction fit engagement in said seat, whereby said stem is releasably engageable with said seat.

15. A material applicator as claimed in claim 13 wherein a portion of said stem extends beyond said top section, whereby to displace said applicator therefrom.

* * * * *